United States Patent [19]

Brison

[11] Patent Number: 4,830,224

[45] Date of Patent: May 16, 1989

[54] SAFETY AND TAMPER-PROOFING DEVICE FOR A NASAL TYPE SPRAY

[76] Inventor: Marc Brison, 4 rue Robert d'Artois, 27170 Beaumont Le Roger, France

[21] Appl. No.: 111,757

[22] Filed: Oct. 23, 1987

[30] Foreign Application Priority Data

Oct. 23, 1986 [FR] France ..... 86 14695

[51] Int. Cl.[4] ..... B67B 5/00

[52] U.S. Cl. ..... 222/153; 222/402.11; 222/562

[58] Field of Search ..... 222/153, 402.11, 402.13, 222/182, 542, 538, 562, 544, 559, 541; 215/26, 27, 28, 254, 253, 256, 257

[56] References Cited

U.S. PATENT DOCUMENTS

| | | | |
|---|---|---|---|
| 2,610,940 | 9/1952 | Endicott | 222/402.11 |
| 2,706,660 | 4/1955 | Johnson et al. | 222/402.11 |
| 3,180,532 | 4/1965 | Michel | 222/402.11 |
| 3,185,350 | 5/1965 | Abplanalp et al. | 222/402.11 |
| 3,884,393 | 5/1975 | Wassilieff | 222/402.11 |
| 4,735,346 | 4/1988 | Stoody | 222/153 |

*Primary Examiner*—Kevin P. Shaver
*Assistant Examiner*—Kenneth Noland
*Attorney, Agent, or Firm*—Sughrue, Mion, Zinn, Macpeak and Seas

[57] ABSTRACT

An operating safety and tamper-proofing device for a spray, the spray being of the type comprising a valve (2) for mounting on a receptacle such as a can, an axial ejection elongate spray head (4) such as a nasal spray with actuator means of the type including two diametrically opposite wings (6) on either side of the spray head for receiving fingers, a protective cap (7), and a sleeve (3) surrounding the valve for determining, together with the spray head and/or the finger-receiving wings, safety means for preventing the spray from operating depending on the angular position of the spray head and/or the finger-receiving wings relative to the sleeve, wherein the finger-receiving wings constitute a part which is independent from the spray head and which is preferably engaged thereon by wedging.

6 Claims, 8 Drawing Sheets

SAFETY AND TAMPER-PROOFING DEVICE FOR A NASAL TYPE SPRAY

BACKGROUND OF THE INVENTION

The present invention relates to a safety device for an aerosol spray, and more particularly for pumps and cans which include a pushbutton in the form of two finger-receiving wings. Some spray heads include an outlet nozzle on the thrust axis (for example a nasal spray) and cannot therefore be operated by exerting thrust directly on the same axis, whence the use of finger-receiving wings. The shape of these finger-receiving wings complicates the molding of spray heads and constrains design possibilities. The invention seeks, in particular, to ensure safety during use and during transport, i.e. to prevent unwanted operation, and to provide tamper-proofing for the container (and its contents) and for the pump or valve mechanism up to the first occasion of use. These results may be obtained in known manner by adding a tear-off ring to the spray head or to a protective cap for covering and protecting the head when not in use. This ring may prevent the head from being depressed, thus preventing it from operating. The head can only be depressed after the ring has been removed by tearing through a certain number of attachment points or lines. However, it is expensive and difficult to manufacture a spray head including both a tear-off ring and laterally-projecting finger-receiving wings by molding, and complicated molds are required.

SUMMARY OF THE INVENTION

According to the present invention, a cheap, convenient and practical device is obtained by making a spray head whose finger-receiving wings are constituted by a part which is independent from the spray head. In the device according to the invention, the spray head is mounted so as to be capable of rotating on itself about the thrust axis, and the device comprises a sleeve surrounding the valve rod and the spray head. This sleeve has two diametrically opposite cutouts for passing the finger-receiving wings when they are angularly disposed to face the cutouts. When the spray head is rotated together with the wings, it can no longer be actuated, with the arms formed on the sleeve between the cutouts preventing the finger-receiving wings from descending. The device thus comprises, in addition to the valve: a spray head, a cap, and a sleeve. According to the invention, the finger-receiving wings may be molded integrally with the cap and may be detached therefrom when the spray is first used, or else they may be molded separately. The sleeve may be made independently, or else it may be molded with the cap in which case it is detached on first use.

BRIEF DESCRIPTION OF THE DRAWINGS

Embodiments of the invention are described, by way of example, with reference to the accompanying drawings, in which.

MORE DETAILED DESCRIPTION

Figure 1:
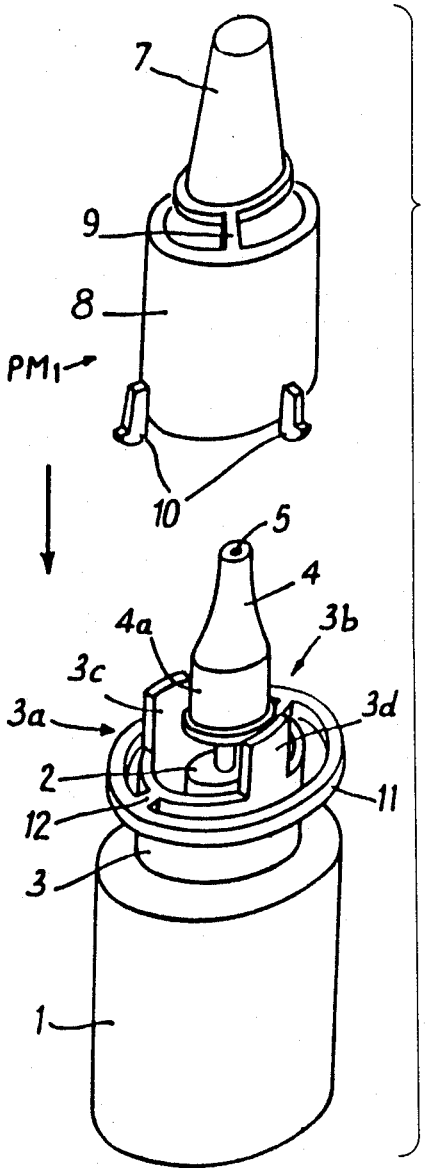
FIG. 1 is a perspective view of a device in accordance with the invention prior to final assembly.
Figure 4:
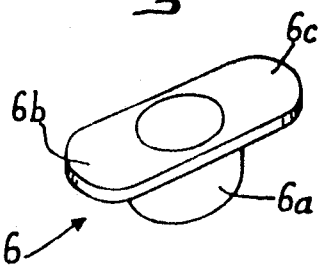
FIG. 4 is a perspective view of one of the parts (the finger-receiving wings) of the device in accordance with the invention.

FIG. 1 shows a can 1 fitted with a valve 2. The valve may be a depressable valve designed to release a product contained under pressure in the can, or else it may be a pump which expels the contents of the can when actuated. The valve 2 may be crimped or screwed to the neck of the can, preferably in conjunction with an anti-unscrewing system such as a non-reversible latching notch in order to guarantee for the purchaser that the contents of the can is complete. A cylindrical sleeve 3 is placed around the valve 2 and the top portion of the sleeve has cutouts 3*a* and 3*b* which delimit arms 3*c* and 3*d* therebetween. The sleeve may be integrally molded with the can if the can is made of molded material, or else it may be fixed to the can by any appropriate means. Preferably, it should be fixed so as to be incapable of rotating about the can so as to facilitate operation and use. A spray head 4 is mounted on the valve and has a spray nozzle 5 at the end thereof. Since it is not possible to spray the product in the can be pressing on the end of the spray head, i.e. because the spray nozzle would then be obstructed, the spray head is actuated by finger-receiving means 6 in the form of a tube 6*a* having two wings 6*b* and 6*c* (FIG. 4). The finger-receiving means is distinct from the spray head and is delivered separately to the consumer within the same packaging. The finger-receiving means 6 is preferably wedged on the cylindrical portion 4*a* of the spray head 4 and bears downwardly on a flange formed at the bottom of the spray head. In order to obtain proper fitting, the bore of the finger-receiving means may include a flat, or else the cylindrical portion 4*a* of the spray head may be slightly conical and/or may be non-circular in section. It can be seen, that if the finger-receiving means is rotated so that the wings 6*b* and 6*c* can engage between the arms 3*c* and 3*d* of the sleeve 3, then the spray head can be actuated and the product contained in the can extracted. If the finger-receiving means is suitably rotated, preferably through 90° from the preceding position, it can no longer be depressed and the valve cannot be actuated.

The device constituting this first embodiment of the invention also includes a cap 7 and a tamper-proofing ring 8. The cap 7 and the ring 8 are interconnected by breakable stubs 9 to constitute an independent molded part PM1. The ring has other breakable stubs 10 for co-operating with a circle 11 fixed to the sleeve 3 by breakable stubs 12. The stubs 10 are shaped so as to snap-fasten beneath the circle 11; however the stubs 10 cannot be extracted from the circle 11 without breaking the stubs 10 or the stubs 12.

Figure 2:
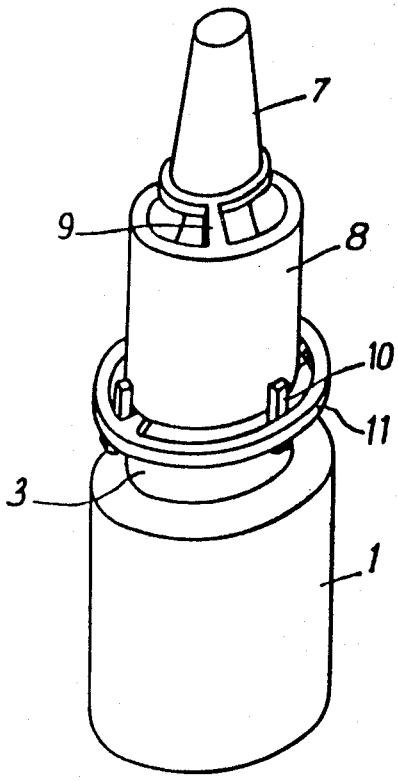
FIG. 2 is a perspective view of the FIG. 1 assembly shown assembled and prior to first use.
Figure 3:
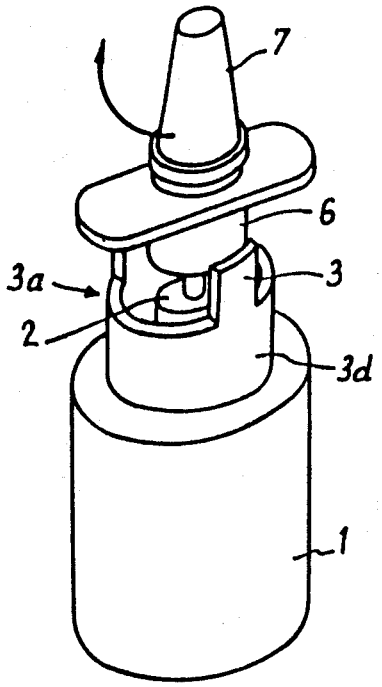
FIG. 3 is a perspective view of the device after the tamper-proofing items have been removed.
Figure 5:
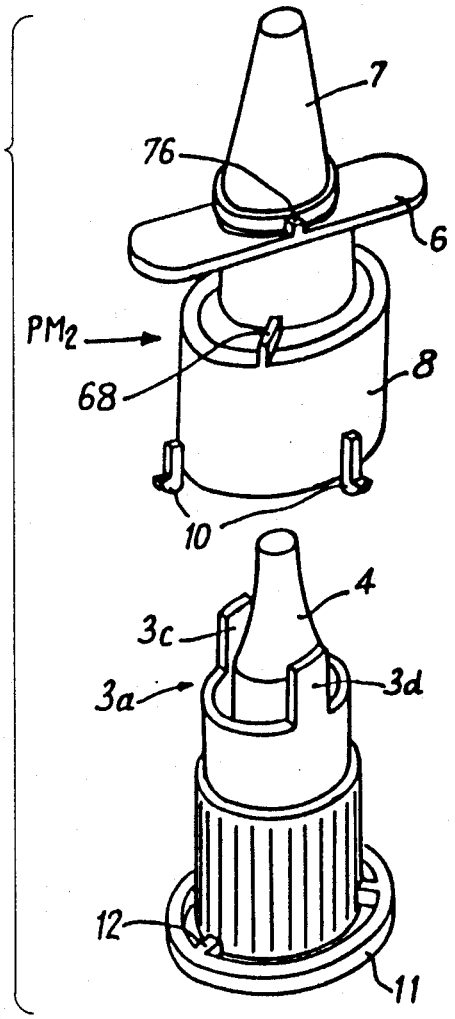
FIGS. 5 to 8 show another variant embodiment of the invention.
Figure 6:
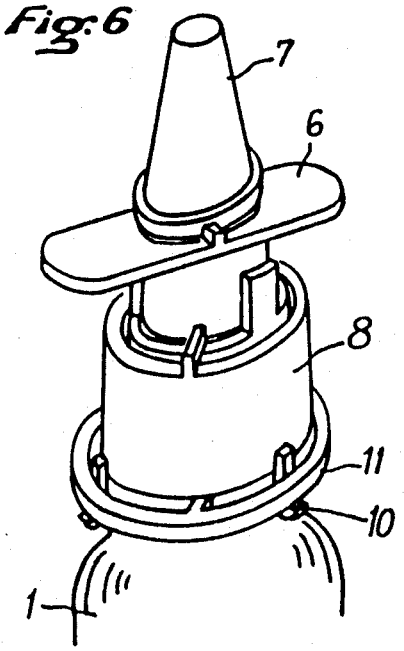
Figure 7:
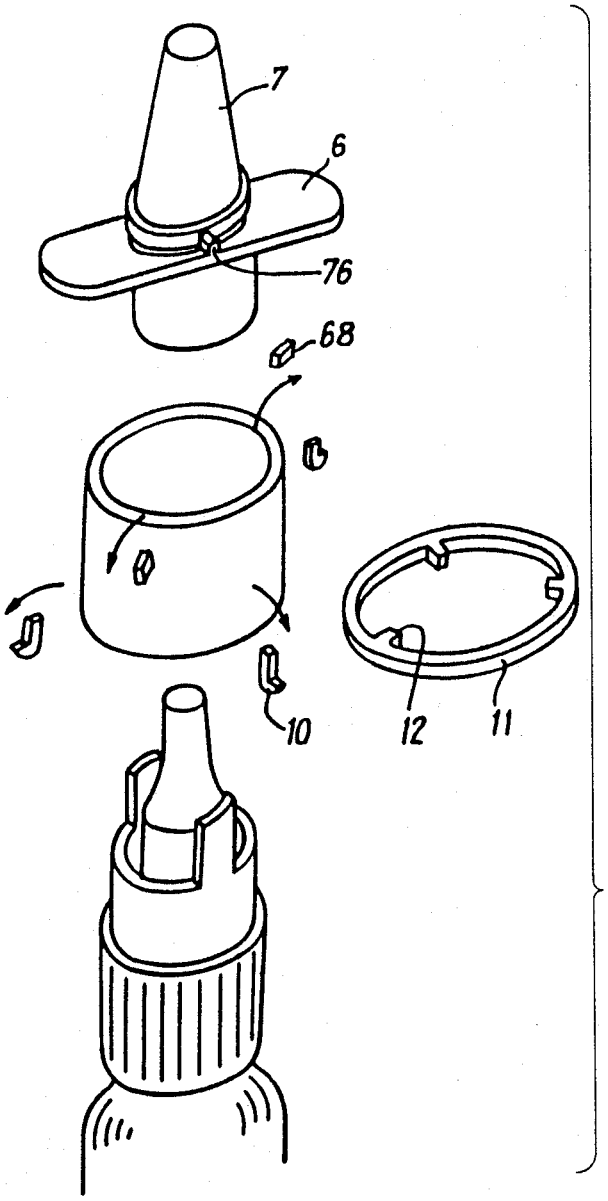

FIG. 2 shows both portions of the device shown in FIG. 1 in the assembled state as delivered to the vendor. In order to put the apparatus into service, the stubs 9 must be broken as must the stubs 10 or 12, and preferably both sets. The ring 8 is thrown away and the finger-receiving means 6 is threaded over the spray head 4, thereby enabling the apparatus to be actuated after the finger-receiving wings have been properly oriented. After use, the finger-receiving wings are turned to a safety position and the cap is put into place. Appropriate snap-fastening means of conventional type serve to hold the finger-receiving wings temporarily in the safety position. FIG. 3 shows the apparatus ready for use.

FIGS. 5 to 8 show a variant embodiment of the invention in which the finger-receiving means are integrally molded with the cap rather than being delivered separately, and constitute together with the cap and the tamper-proofing ring an independent molded part PM2. The finger-receiving means is separated by the user prior to use. The can 1 is not shown for the purpose of simplification. The spray head and the sleeve 3 surrounding it together with the arms 3*c* and 3*d* separated by the cutouts 3*a* and 3*b* can all be seen. The second portion is constituted by a molded part PM2 of plastic material comprising a cap 7, finger-receiving means 6, and a ring 8. The ring has stubs 10 which co-operate with the circle 11 fixed to the receptacle by means of stubs 12. The cap 7 is connected to the finger-receiving means 6 via breakable stubs 76 and the finger-receiving means 6 is connected to the ring 8 by breakable stubs 68. The assembly is shown assembled in FIG. 6.

Figure 8:
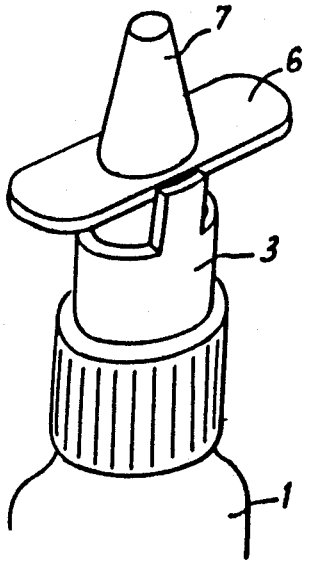
Figure 9:
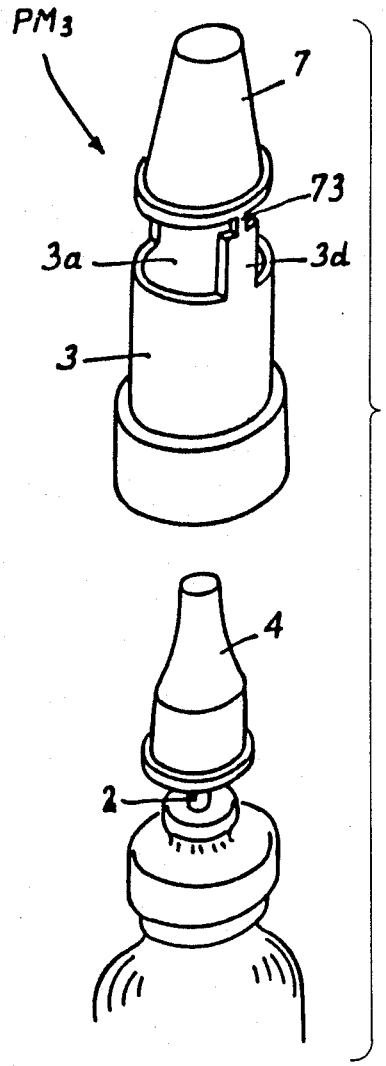
FIGS. 9 to 13 show yet another variant embodiment of the invention.

In order to put it into operation (FIGS. 7 and 8), the user must break the stubs 78, 68, 10, and 12. The circle 11 is thrown away together with the pieces of stub. The finger-receiving means is put into place and the assembly is ready for use (FIG. 8).

Figure 10:
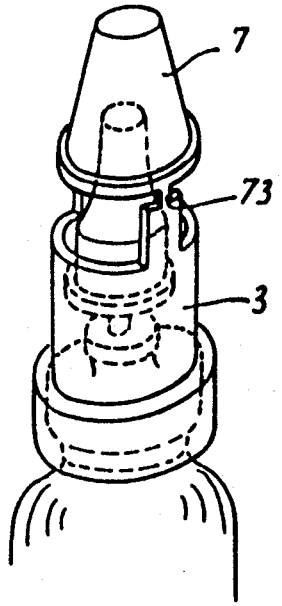
Figure 11:
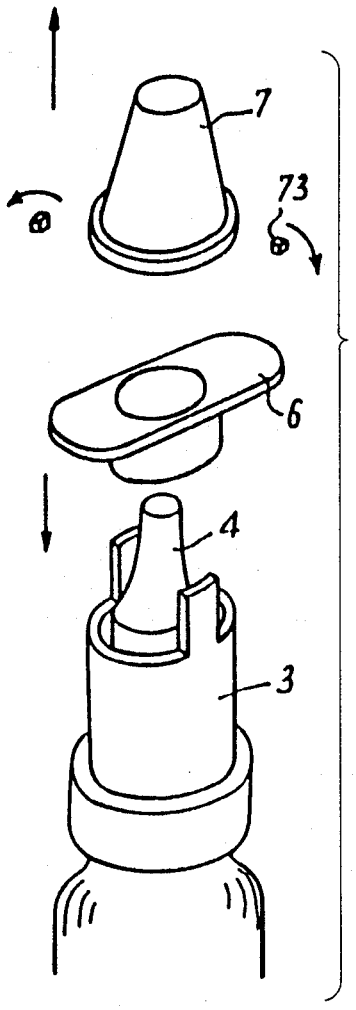
Figure 12:
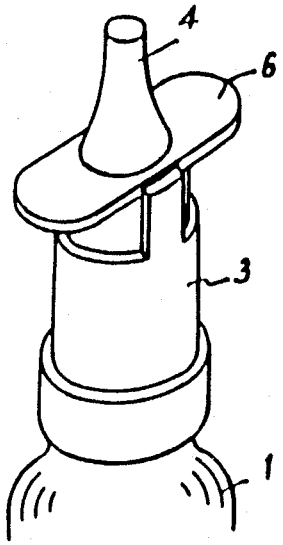
Figure 13:
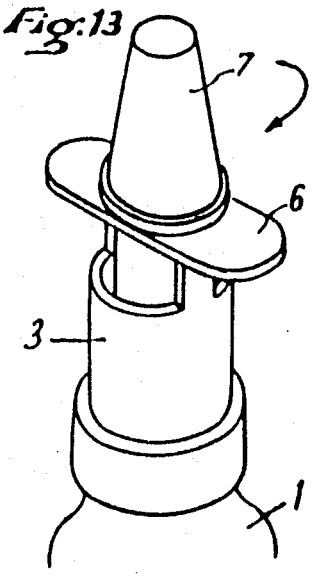

FIGS. 9 to 13 show a variant embodiment of the present invention in which the cap 7 is integrally molded in a single part PM3 together with the sleeve 3 having its arms and safety cutouts 3*a*, 3*b*, 3*c*, 3*d*, and with breakable stubs 73. Unlike the preceding embodiments, the sleeve is not initially fixed to the can but is fixed thereto, when sent to the distributor, by non-reversible snap-fastening (FIG. 10). In order to put the apparatus into operation, the user must break the stubs 73 (FIG. 11), thereby releasing the cap, and place finger-receiving means delivered with the can but not fixed thereto. The apparatus is then ready for use (FIG. 12) and after use it can be put into a safety position by rotation through 90° (FIG. 13).

Figure 14B:
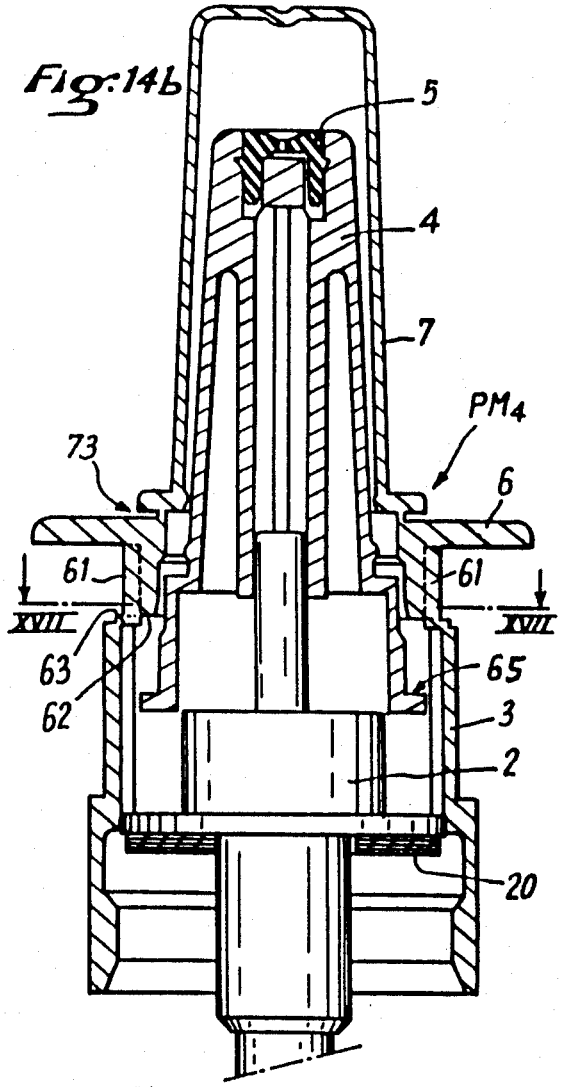
FIGS. 14 to 17 show yet another variant embodiment of the invention, with FIG. 17 being a section on line XVII—XVII of FIG. 14*b*.
Figure 14A:
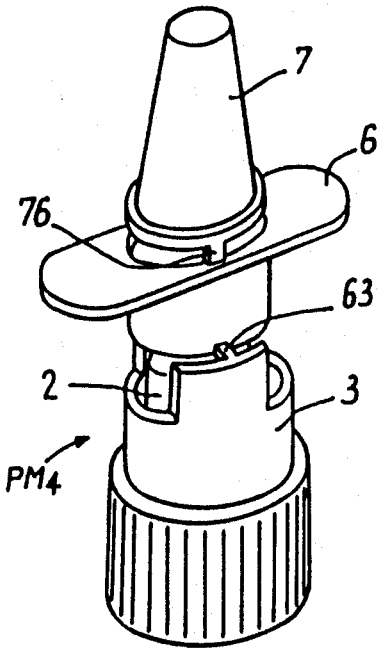
Figure 14C:
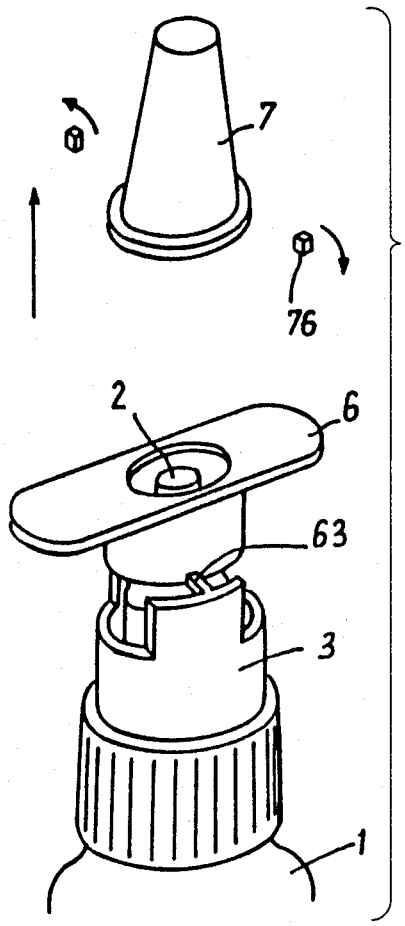
Figure 16A:
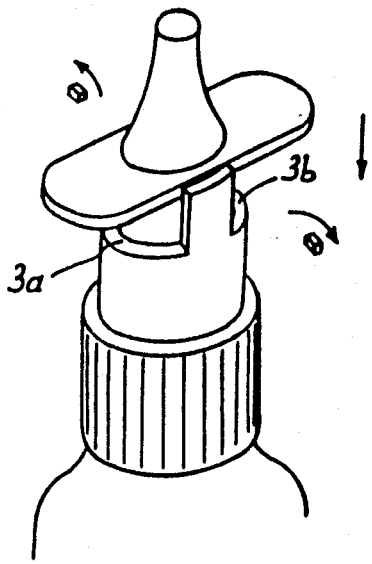
Figure 15A:
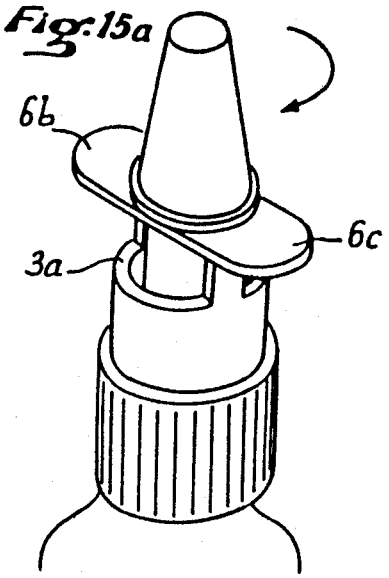
Figure 15B:
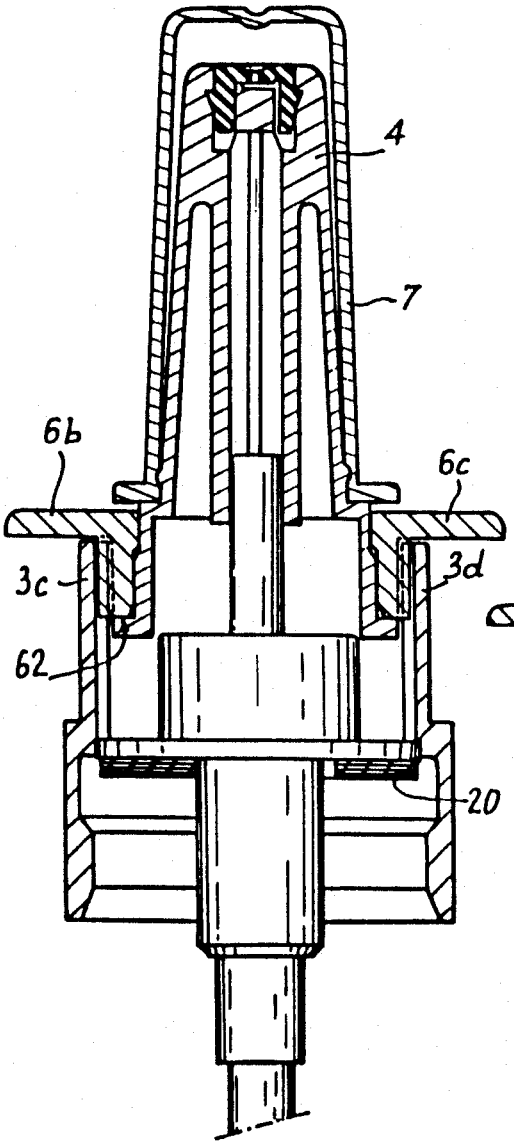
Figure 16B:
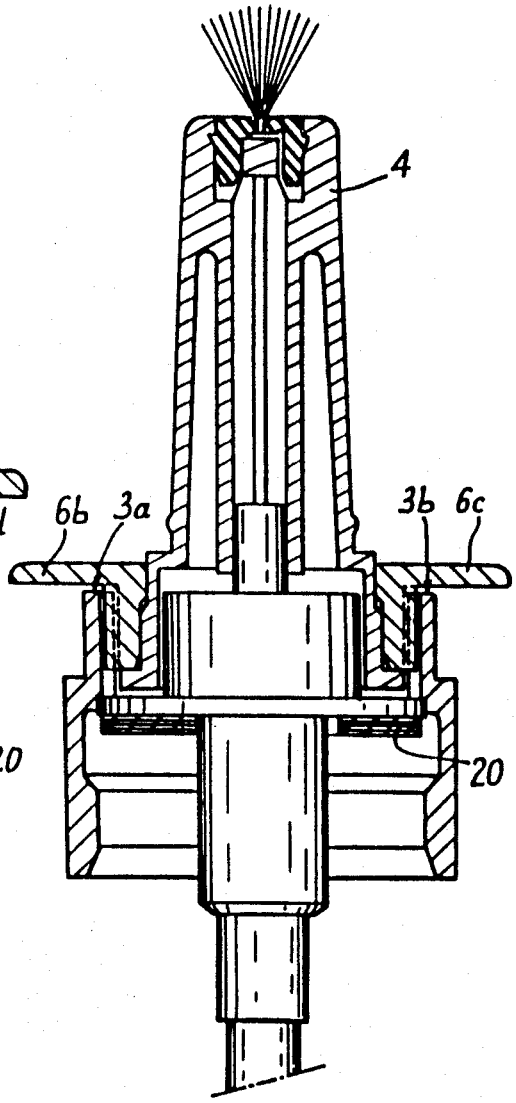

Like the embodiment shown in FIGS. 5 to 8, the molded part PM4 shown in FIGS. 14*a* and 14*b* includes the finger-receiving means. The cap is connected via breakable stubs 76 to the finger-receiving means 6 which is connected in turn via breakable stubs 63 to the sleeve 3. In the FIG. 14*a* variant, the sleeve 3 is mounted on the neck of the can, flask or the like by screwing, preferably with a non-reversible (i.e. unscrewable) locking latch. In the FIG. 14*b* variant, the sleeve 3 is of a type suitable for snapping directly onto the neck of a flask in order to fix the valve 2 thereon together with an intervening sealing ring 20. Otherwise the two embodiments are equivalent. The goods are sent to the vendor in the form shown in FIG. 14*b* or 15*b*. In order to put the device into operation, the user breaks the stubs 76 and 63 (FIGS. 14*c* and 16*a*), and lowers the finger-receiving means to its operating position on the spray head 2. The user then places the cap (FIG. 15*a*) into position. When the device is in its safety position (FIGS. 15*a* and 15*b*) the finger-receiving wings 6*b* and 6*c* press against the arm 3*c* and 3*d* of the sleeve 3. The finger-receiving means cannot be depressed and the device cannot eject any product. When the finger-receiving means is turned through 90° (FIGS. 16*a* and 16*b*) it is capable of moving down into the cutouts 3*a* and 3*b* of the sleeve 3, and the product may be ejected (FIG. 16*b*). The bottom surface 62 of the finger-receiving means situated in an axial plane bears, when in its operating position, against a flange or shoulder 65 on the spray head, thereby positively driving it regardless of the degree of wedging between the concentric contacting surfaces between the spray head and the finger-receiving means.

Figure 17:
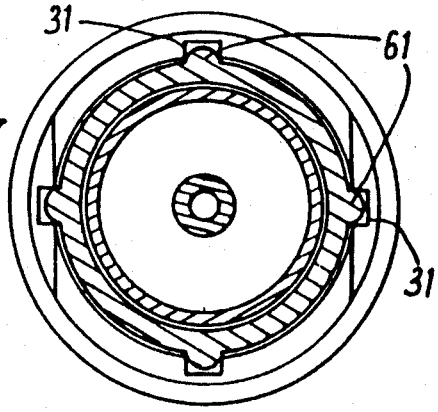

In order to ensure that the device operates properly, the outside surface of the tube 6*a* of the finger-receiving means 6 may be provided with at least one radial rib 61 co-operating with grooves 31 formed in the inside surface of the sleeve 3 (see FIG. 17). The snap-fastenings determined in this way defines two positions at right angles for the finger-receiving means. In one of these positions the spray head may be depressed using the finger-receiving means, while the other position is a safety position in which it cannot be depressed. By virtue of this snap action, the spray head remains in the position in which it is put. When so desired it depresses when pressed upon, however when in its safety position it does not randomly move away therefrom, for example in a handbag.

I claim:

1. An operating safety and tamper-proofing assembly for a spray dispensing valve (2) mounted on a portable pressurized container (1) and extended by an elongate spray head (4) having a top and a base, the spray being emitted upwardly, characterized by:

(a) a protective cap (7) for said spray head, (b) finger-receiving means (6) formed by a hollow cylinder (6*a*), an inner cross-section of which is complementary to said spray head base, said hollow cylinder being equipped with two diametrically opposed wings (6*b*,6*c*) projecting radially outwardly for receiving fingers of an operator, and (c) a sleeve (3) fixed relative to said container, comprising an upper part and a lower part, said lower part surrounding said valve and said upper part having two diametrically opposed arms (3*c*,3*d*) extending upwardly, wherein (d) when said finger-receiving means are wedged on said spray head and pressed downwardly, either said wings abut said arms and the valve remains closed, or said wings move downwardly between said arms and the valve is operably opened, depending on the angular rotation of said spray head relative to said container, and (e) said cap and at least said sleeve are molded together as a single molded piece, said cap and at least said sleeve being easily separable by breaking frangible elements (73) of said molded piece.

2. An assembly according to claim 1, wherein said finger-receiving means are also molded together with said cap and said sleeve in order to initially form said single molded piece, said finger-receiving means also being easily separable from said cap and said sleeve by breaking frangible elements (63,76) of said molded piece.

3. An assembly according to claims 1, 2, 4 or 5, wherein said breakable frangible elements of said molded piece comprise thin stubs, spaced relative to each other, and bridging a small gap provided between the different components of said molded piece.

4. An operating safety and tamper-proofing assembly for a spray dispensing valve (2) mounted on a portable pressurized container (1) and extended by an elongate spray head (4) having a top and a base, the spray being emitted upwardly, characterized by:

(a) a protective cap (7) for said spray head, (b) finger-receiving means (6) formed by a hollow cylinder (6*a*), an inner cross-section of which is complementary to said spray head base, said hollow cylinder being equipped with two diametrically opposed wings (6*b*,6*c*) projecting radially outwardly for receiving fingers of an operation, (c) a sleeve (3) fixed relative to said container, comprising an upper part and a lower part, said lower part surrounding said valve and said upper part having two diametrically opposed arms (3*c*,3*d*) extending upwardly, and (d) a tamper-proofing ring (8) having a top and a base, wherein (e) when said finger-receiving means are wedged on said spray head and pressed downwardly, either said wings abut said arms and the valve remains closed, or said wings move downwardly between said arms and the valve is operably opened, depending on the angular rotation of said spray head relative to said container, (f) said cap and at least said tamper-proofing ring are molded together as a single molded piece, said cap and at least said tamper-proofing ring being easily separable by breaking frangible elements (9) of said molded piece, and (g) said tamper-proofing ring and said sleeve are provided with complementary snap-fastening means (10,11) so designed that said tamper-proofing ring and said sleeve cannot be separated without breaking said snap-fastening means.

5. An assembly according to claim 1, wherein said finger-receiving means are also molded together with said cap and said tamper-proofing ring in order to initially form said single molded piece, said finger-receiving means also being easily separable from said cap and said tamper-proofing ring by breaking frangible elements (68,76) of said molded piece.

6. An assembly according to claim 4 or claim 5, wherein said snap-fastening means comprise an annulus (11) secured around said sleeve by a plurality of spaced, short frangible stubs (12), and a plurality of pawls (10) protruding downwardly from said tamper-proofing ring base so that said pawls snap-fasten radially inwardly of said annulus.

* * * * *